US005440318A

United States Patent [19]

Butland et al.

[11] Patent Number: 5,440,318

[45] Date of Patent: Aug. 8, 1995

[54] PANEL ANTENNA HAVING GROUPS OF DIPOLES FED WITH INSERTABLE DELAY LINES FOR ELECTRICAL BEAM TILTING AND A MECHANICALLY TILTABLE GROUND PLANE

[76] Inventors: Roger J. Butland, 47 John Sims Drive, Boadmeadows, Wellington, New Zealand; William E. Heinz, 47 Beazley Avenue, Wellington, New Zealand

[21] Appl. No.: 147,010

[22] Filed: Nov. 2, 1993

Related U.S. Application Data

[63] Continuation of Ser. No. 747,867, Aug. 20, 1991, abandoned.

[30] Foreign Application Priority Data

Aug. 22, 1990 [NZ] New Zealand ..... 235010

[51] Int. Cl.[6] ..... H01Q 3/20; H01Q 3/30; H01Q 21/12

[52] U.S. Cl. ..... 343/814; 343/815; 343/822; 343/861; 343/882; 342/375

[58] Field of Search ..... 342/375; 343/700 MS, 343/811–818, 880, 882, 761, 820, 822, 861; H01Q 1/38, 3/20, 3/30, 1/12, 21/12, 21/22

[56] References Cited

U.S. PATENT DOCUMENTS

| | | | |
|---|---|---|---|
| 2,462,881 | 3/1949 | Marchetti | 343/814 |
| 2,533,054 | 12/1950 | Schouten | 343/814 |
| 3,249,946 | 5/1966 | Flanagan | 343/882 |
| 3,747,114 | 7/1973 | Shyhalla | 343/795 |
| 3,750,185 | 7/1973 | Evans | 343/814 |
| 3,887,925 | 6/1975 | Ranghelli et al. | 343/814 |
| 4,563,687 | 1/1986 | Berger | 343/832 |
| 4,710,778 | 12/1987 | Radov | 343/882 |
| 4,843,402 | 6/1989 | Clement | 343/853 |
| 5,012,256 | 4/1991 | Maddocks | 343/814 |

FOREIGN PATENT DOCUMENTS

| | | | |
|---|---|---|---|
| 2165700 | 4/1986 | United Kingdom | 343/700 MS |

OTHER PUBLICATIONS

Yoshihide and Kijima, "Low sidelobe and tilted beam base station antennas for smaller cell systems," (IEEE pp. 138–141, 1989).

*Primary Examiner*—Michael C. Wimer
*Attorney, Agent, or Firm*—Needle & Rosenberg

[57] ABSTRACT

A panel antenna suitable for use in cellular communication applications provided with means for mechanically and electrically adjusting the tilt of the antenna beam. Electrical down tilt being achieved by varying the length of a first feed line to a group of dipole pairs. Mechanical down tilting of the antenna beam being achieved by tilting the antenna ground plane and dipole driver assembly with respect to a housing.

16 Claims, 15 Drawing Sheets

Frequency = 980·0 MHz

Frequency = 890·0 MHz

PANEL ANTENNA HAVING GROUPS OF DIPOLES FED WITH INSERTABLE DELAY LINES FOR ELECTRICAL BEAM TILTING AND A MECHANICALLY TILTABLE GROUND PLANE

This application is a continuation of application Ser. No. 07/747,867, filed Aug. 20, 1991, now abandoned.

BACKGROUND OF THE INVENTION

The present invention relates to a panel antenna. More particularly, but not exclusively, the present invention relates to a panel antenna having both mechanical and electrical means for tilting the beam of the antenna. The antenna of the present invention is considered to be particularly suitable for use in cellular communication systems.

To the present time downward tilting of the beam of an antenna used in a cellular communication system has been achieved by mounting the panel antenna at an angle to the supporting structure. Where panel antennas are to be affixed to the sides of buildings it is preferable that the panel antennas conform as closely as possible with the sides of the buildings for aesthetic reasons and to avoid exposing too great a surface area to the wind. Where conventional mounting arrangements are used a panel may be tilted by as much as 15° with respect to a building, which is unsightly, poses mounting difficulties and exposes the panel to the full impact of the wind. Likewise with panel antennas mounted on towers it is more asthetically pleasing, and the antennas are easier to mount and adjust if they are mounted perpendicularly.

Another method of downwardly tilting the beam of a panel antenna is to electronically phase shift the signal received by or transmitted from each dipole pair an amount corresponding with the desired degree of beam tilt. As the amount of downward tilt required for each site varies (depending upon the height of the base-station etc) this would require the use of variable phase shifting elements which would be expensive.

It is an object of the present invention to provide a panel antenna allowing customer adjustable beam down tilt which is relatively cheap and simple whilst being easily mounted and aesthetically pleasing, or to at least provide the public with a useful choice.

BRIEF SUMMARY OF THE INVENTION

According to the invention there is provided a panel antenna including a plurality of dipoles mounted upon a ground plane located within a housing, wherein the ground plane can be tilted with respect to the housing to allow mechanical tilting of the antenna beam, and wherein delay lines of various lengths may be connected into a first feed line from a main feed line to a first dipole pair or group of dipole pairs to alter the electrical length of the first feed line and enable electrical tilting of the antenna beam.

Further aspects of this invention, which should be considered in all its novel aspects, will become apparent from the following description given by way of example of possible embodiments thereof and in which references made to the accompanying drawings wherein;

BRIEF DESCRIPTION OF THE DRAWINGS

FIG. 7: shows the tilting mechanism of FIG. 6 in greater detail.

DETAILED DESCRIPTION OF THE INVENTION

The present invention relates to a panel antenna designed to operate over a wide band width (eg: 820–960 MHz) with constant beam tilt wherein the angle of beam tilt is adjustable by the customer on site.

Figure 1:
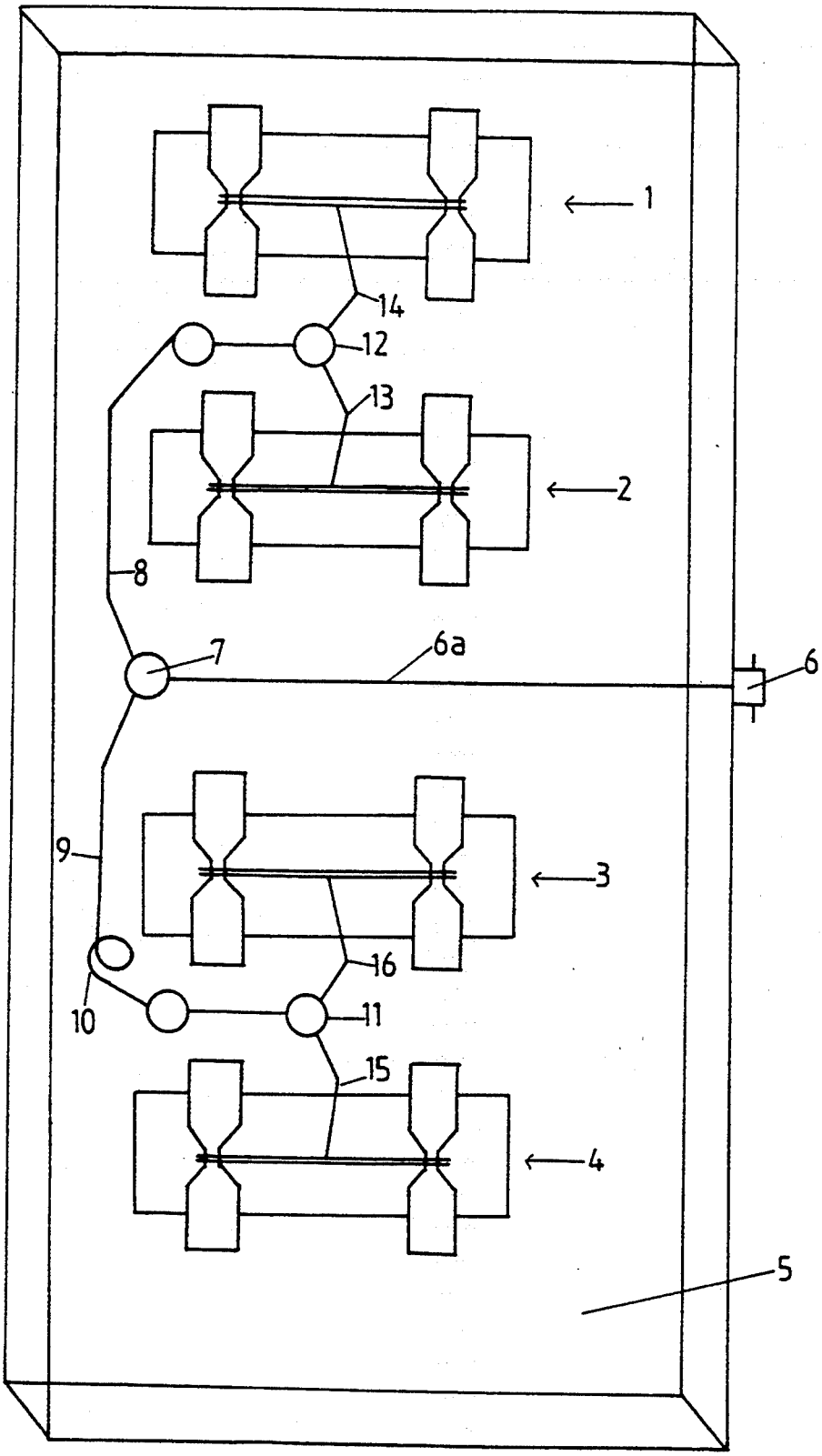
FIG. 1: shows 4 dipole pairs of a panel antenna mounted on a panel.

Referring now to FIG. 1 the feed lines and dipole elements of a four dipole pair panel antenna having a beam width of about 60° are shown. The four pairs of centre fed dipoles 1, 2, 3 and 4 are mounted to a panel 5 which forms the electrical ground plane. Panel 5 is tray shaped and preferably formed of Aluminium. Preferably panel 5 is about 3.41 L high by about 0.94 L wide having side walls about 0.315 L high (where L is the wavelength at the operating frequency). The dipoles in each pair are arranged in parallel and separated by L/2 so that in conjunction with the ground plane 5 they provide an H field beam of 60°. The dipole pairs 1, 2, 3 and 4 are preferably formed of brass and insulated from panel 5 by an insulating layer (such as a double sided foam tape) to avoid corrosion.

A radio frequency signal supplied at connector 6 is fed by main feed line 6*a* to power divider 7 which divides the signal between first feed line 8 and second feed line 9. Line 9 has a turn 10 which makes this line longer than line 8 so that the signal it supplies to power divider 11 is phase delayed with respect to the signal supplied to power divider 12. Likewise line 13 which supplies dipole pair 2 is longer than line 14 supplying dipole pair 1 so that the signal provided to dipole pair 2 is phase delayed with respect to that provided to dipole pair 1. Line 15 is also longer than line 16 so that the signal supplied to dipole pair 4 is phase delayed with respect to that supplied to dipole pair 3.

In this way, from dipole pair 1 to dipole pair 4 the signal received or transmitted by the dipole pair is increasingly phase delayed. This delay produces an apparent down tilting of the beam propagated by the panel antenna.

By altering the length of line 8 the degree of down tilt of the panel antenna can be varied. According to the present invention the length of line 8 may be varied by inserting variable lengths of feed line in line 8. The variable lengths of line may be provided with connectors at either end which plug into connectors on the severed ends of line 8.

Figure 2:
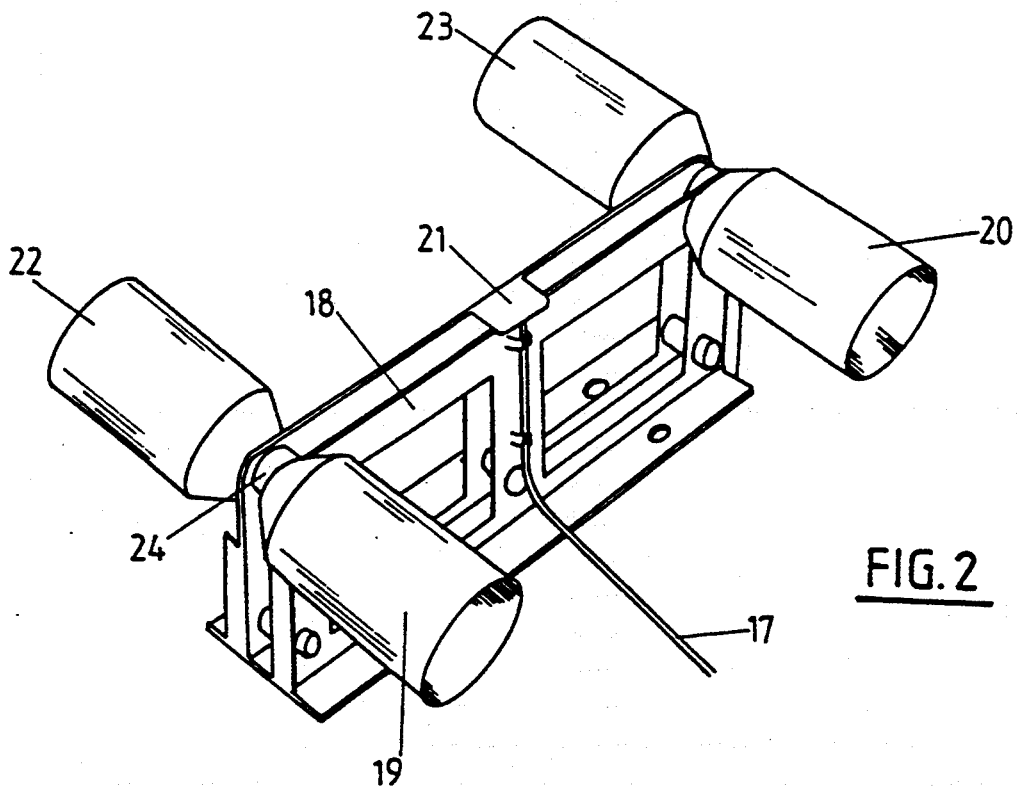
FIG. 2: shows one of the dipole pairs in detail.

Referring now to FIG. 2 a dipole pair is shown. The outer conductor of feed line 17 is soldered to plate 18 and supplies power to radiating elements 19 and 20. The central conductor of feed line 17 is soldered to plate 21 and feeds radiating elements 22 and 23. The radiating elements 19, 20, 22 and 23 are preferably tapered toward the end attached to plate 18 and 21. Radiating elements 19 and 22 and 20 and 23 have insulating spacers 24 therebetween and may be fixed together by insulated securing means. The spacers 24 are preferably formed of PTFE (polytetraflouroethylene) and the radiating elements are preferably secured by nylon screws. This ensures that the assembly is secure and steady against vibrations which may be caused by wind etc.

Figure 3:
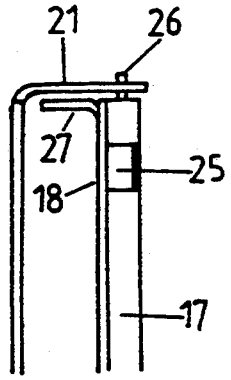
FIG. 3: shows in detail the connection of the feed line to one of the dipole pairs shown in FIG. 2.

Referring now to FIG. 3 the connection of feed line 17 to the dipole pair is shown in more detail. Outer conductor 17 is soldered to plate 18 at formed cleat 25 and inner conductor 26 is soldered to plate 21. Plates 21 and 27 provide capacitive correction to match the dipole pair.

Figure 4A:
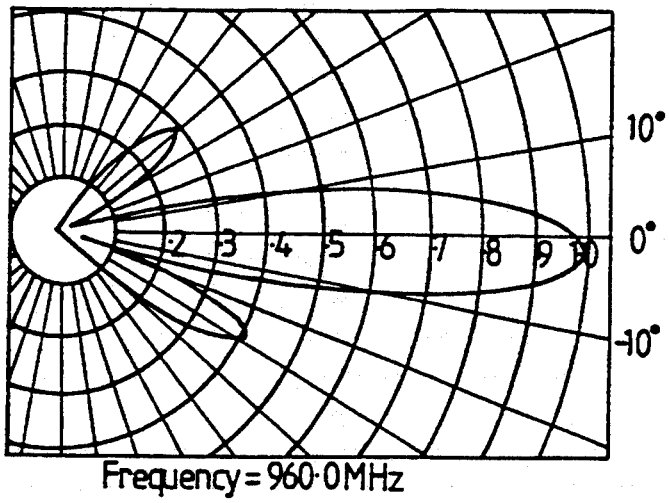
FIGS. 4*a*, 4*b* and 4*c*: show the vertical (E-plane) radiation patterns for 0°, 5° and 10° for a 4 dipole pair antenna.
Figure 4B:
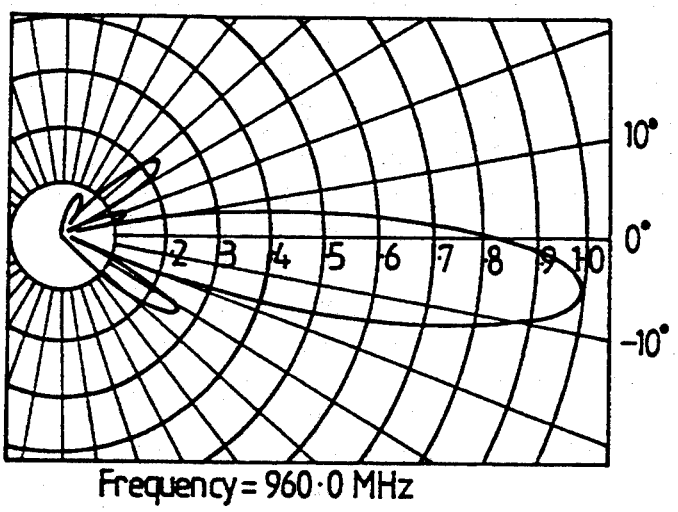
Figure 4C:
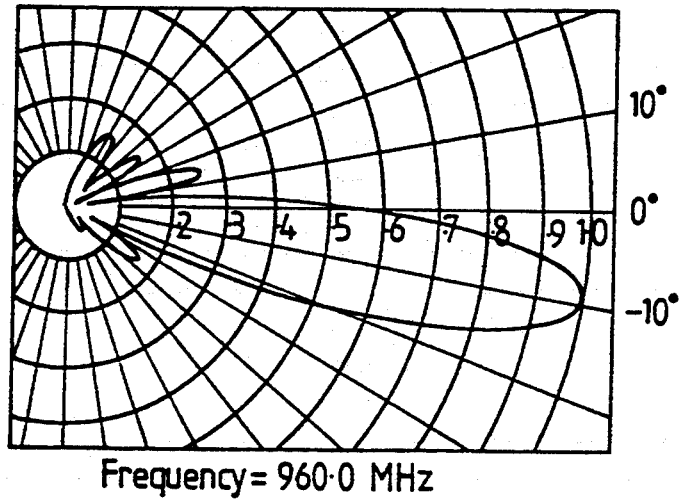
Figure 4D:
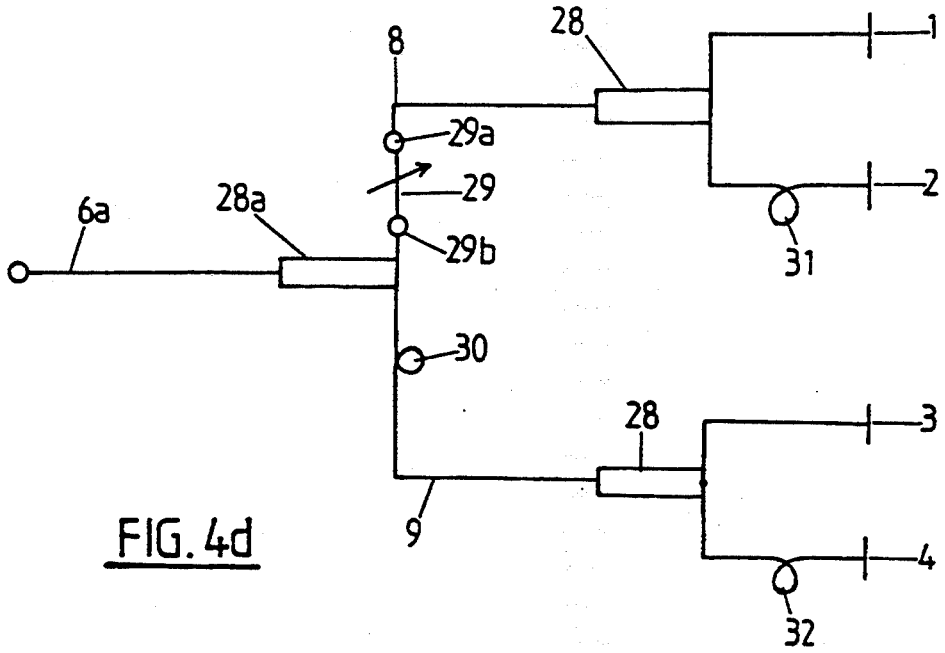
FIGS. 4*d* and 5*d*: show electrical diagrams of the possible configurations for a 4 dipole pair antenna.
Figure 5D:
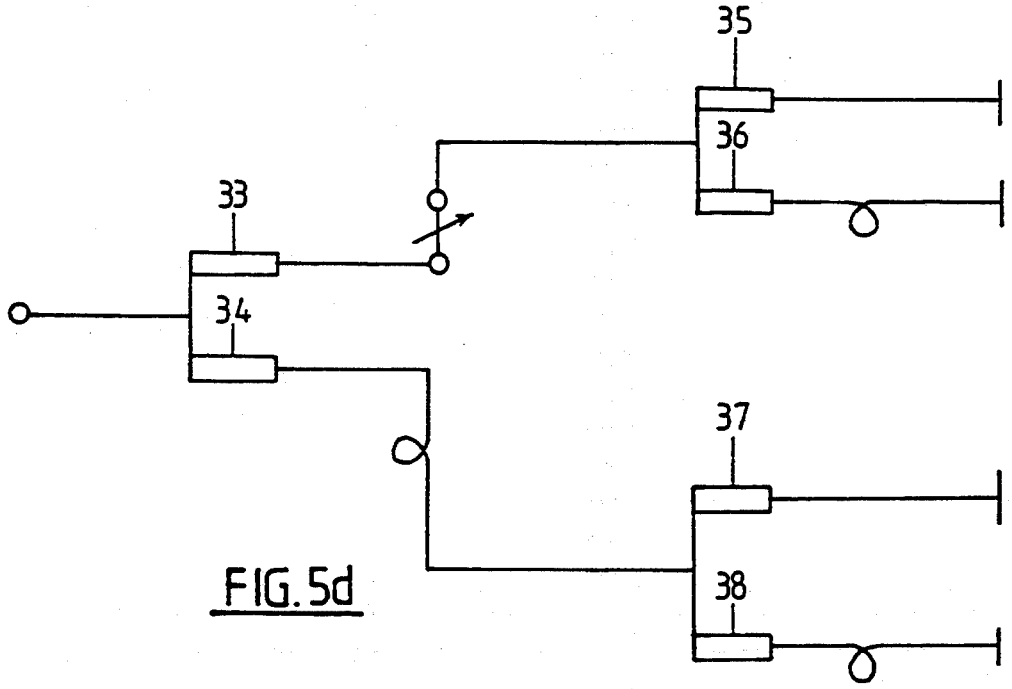
Figure 5A:
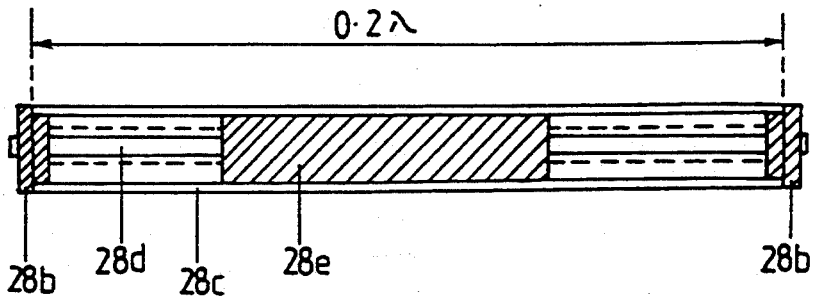
FIG. 5*a*: shows a matching section for matching the panel antenna to a feed line.

Referring now to FIGS. 4*d* and 5*d* electrical circuits of possible configurations are shown. The circuit shown in FIG. 4*d* uses approximately 35 Ohm quarter wavelength power dividers 28. A high power matching section 28*a* is provided to match the antenna impedance to the impedance of cable 6*a*. Matching section 28*a* is shown in FIG. 5*a*. Flanged end caps 28*b* formed of PTFE are provided at either end and support an outer conductive tube 28*c*. A central conductor 28*d* is supported within the outer conductor by the caps 28*b*. A tubular dielectric section 28*e* formed of PTFE can slide along inner conductor 28*d*. The resistance R of the matching section is dependant upon the length of the tubular dielectric section 28*e* (and hence the amount of PTFE).

The reactance can be varied by moving the tubular dielectric section 28*e* toward one end or the other. Movement of the tubular dielectric section 28*e* towards the load end will cause the impedence to go inductive whereas movement towards the cable end will cause the impedence to go capacitive. Once the optimum position has been established the tubular dielectric section 28*e* can be permanently positioned; for example by providing PTFE spaghetti spacers between the tubular dielectric sections and the end caps 28*b*. Preferably the length of the matching section will be one fifth of the operating wavelength.

Referring back to FIG. 4*d*, in this embodiment each dipole pair 1, 2, 3 and 4 receives the same power although the signal is phase delayed from dipole pair 1 to dipole pair 4. The phase delays 30, 31 and 32 are fixed and will normally merely consist of an extra length of feed line. Preferably delay 31 is the same as delay 32 and is selected to give the best sidelobe pattern. Phase delay 29 is variable and in the preferred embodiment of this invention tilting of the antenna beam is achieved by varying the length of cable between connectors 29*a* and 29*b*. It is the ratio of the delays 29 to 30 which provides most of the main lobe down tilt. Accordingly, the desired amount of down tilt can be obtained by a customer merely by selecting the required length of cable 29 from a selection of lengths.

Where the panel antenna is to be used in cellular communication systems it should have little radiated power at angles above the main lobe extending to approximately 10° above the horizon. As frequencies may be reused outside a given cell this minimises interference in communications systems.

In an array with constant element separation d, the required degree of down tilt t may be achieved by feeding the elements with a progressive phase shift S given by:

$$S = \frac{360 \times d}{L} \sin t$$

where L is the wavelength at the frequency of operation.

However, with only one phase adjuster and many dipole pairs the phase of signal supplied to each dipole pair cannot be optimum for all angles of down tilt. Thus the radiation pattern must be optimised for a selected angle of down tilt and performance compromised for the other angles.

In one embodiment four dipole pairs were used and the best compromise was achieved for a down tilt of 10°. If d=0.8 L then S=50° (thus elements 31 and 32 in FIG. 4*d* are phase delays of 50°). The radiation pattern obtained when the phase shift between delay 29 and delay 30 (delay 29–delay 30) is 0°, 50.2° and 100° is shown in FIGS. 4*a*, 4*b* and 4*c* respectively. It is seen in FIG. 4*c* that the upper lobes are miniraised when the angle of down tilt is 10°.

Referring now to FIG. 5*d*, this circuit incorporates power dividers 33, 34, 35, 36, 37 and 38. These power dividers may have differing characteristics to give different power division. This may enable better control of the sidelobes.

Figure 4E:
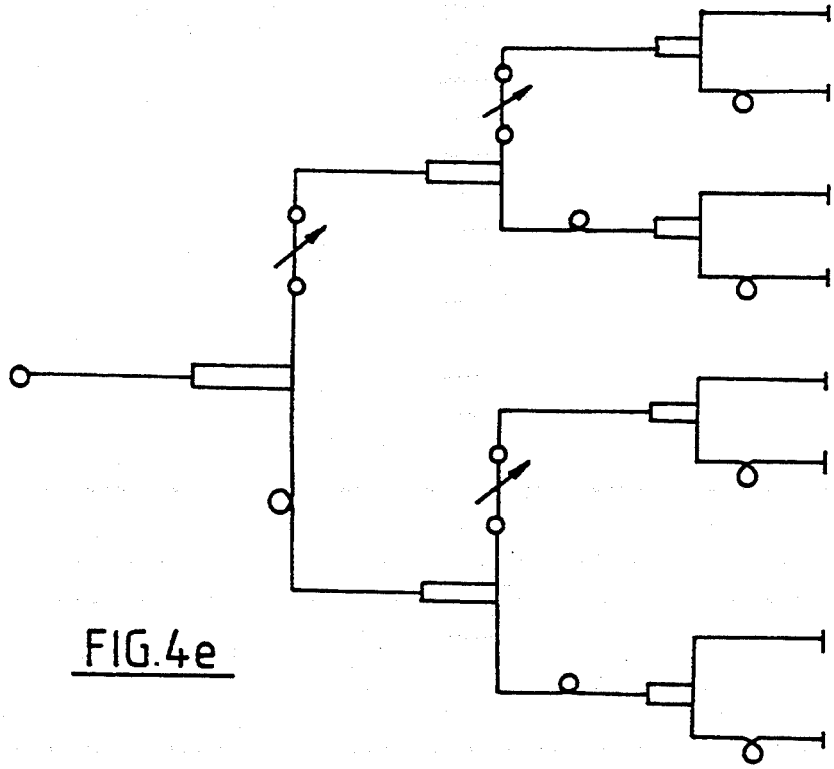
FIGS. 4*e* and 5*e*: show electrical diagrams of the possible configurations for an 8 dipole pair antenna.
Figure 5E:
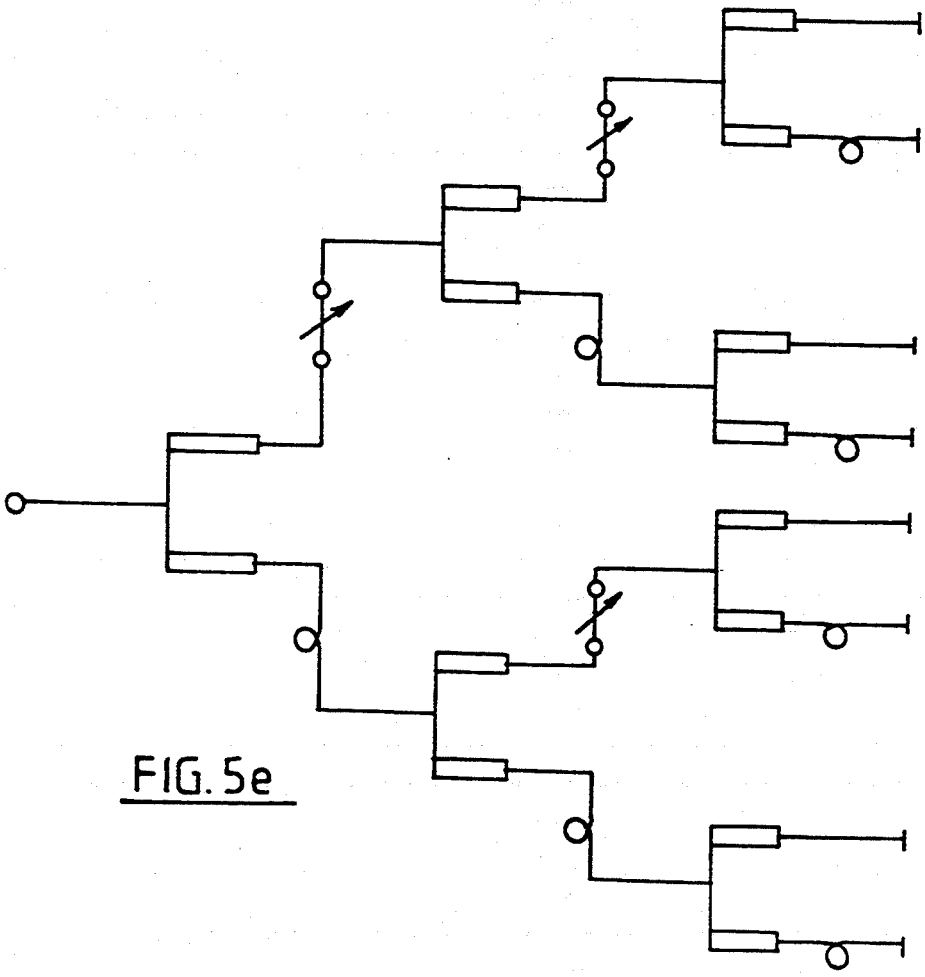

Embodiments incorporating 8 dipole pairs are shown in FIGS. 4*e* and 5*e*.

It is to be appreciated that other numbers of dipole pairs may be used in other embodiments. Embodiments incorporating 2, 4, 8 or 16 . . . dipole pairs are preferred.

The previous description relates to a 60° H-plane beamwidth embodiment (the beamwidth being measured at the half power points). The beamwidth in this embodiment is determined by the length, width and height of the tray 5. These dimensions also affect the unwanted power distribution outside the main beam.

Figure 16:
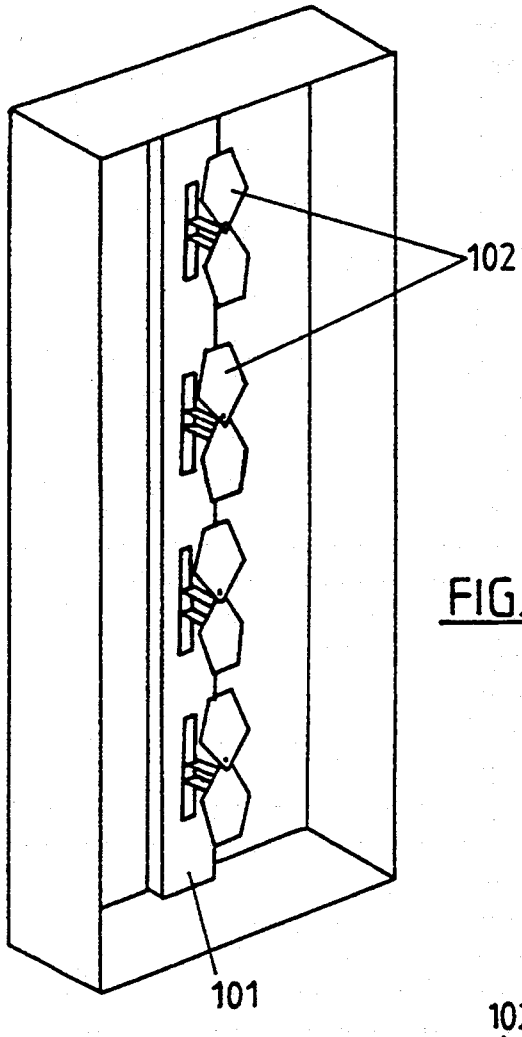
FIG. 16: shows a wide beam panel antenna embodiment.
Figure 17A:
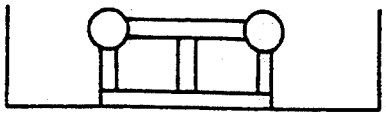
FIGS. 17*a–e*: show various possible panel antenna configurations.

In other embodiments a wider beamwidth over the range 60°–120°, or even to 180° may be required. In such wide beamwidth embodiments a single row of dipoles is preferred to achieve the desired beam. In FIG. 16 a single row of dipoles 102 are shown mounted upon conduit 101. In this form of construction the conduit 101 can act as the first level of a "compound ground plane". Further, the conduit 101 can provide a channel to carry the feed lines. FIG. 17*a* shows an end on view of the panel antenna shown in FIG. 1.

Figure 18:
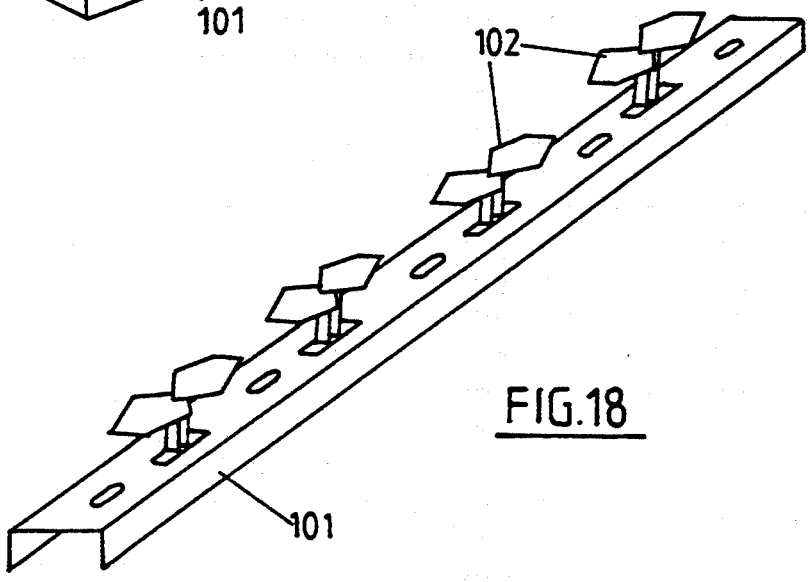
FIG. 18: shows the single row dipole array panel driver of FIG. 16.
Figure 17B:
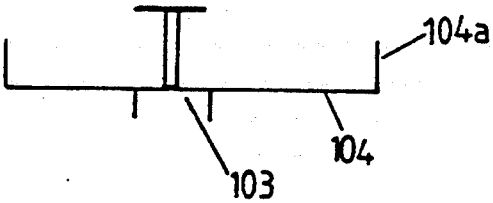
Figure 17C:
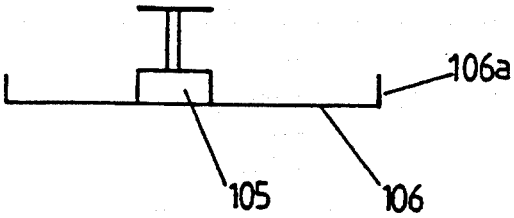

FIGS. 17*b–e* show embodiments incorporating the panel driver shown in FIG. 18. In FIG. 17*b* the panel driver 103 is seen to be on the same level as ground plane 104. In FIG. 17*c* the conduit of panel driver 105 forms the first level of a ground plane with ground plane 106 forming the second level. This configuration gives a similar effect to tilting the ground plane back slightly.

Figure 17D:
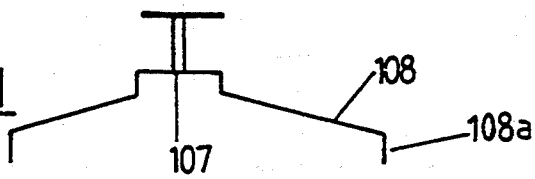

FIG. 17*d* shows an embodiment in which ground planes 108 are tilted backwardly from the direction of beam propagation. This produces greater beamwidth. In the embodiment shown in FIG. 17*e* ground planes 110 project backwardly from the top edges of the conduit of panel driver 109.

Figure 17E:
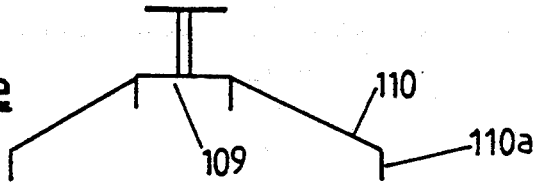
Figure 17F:
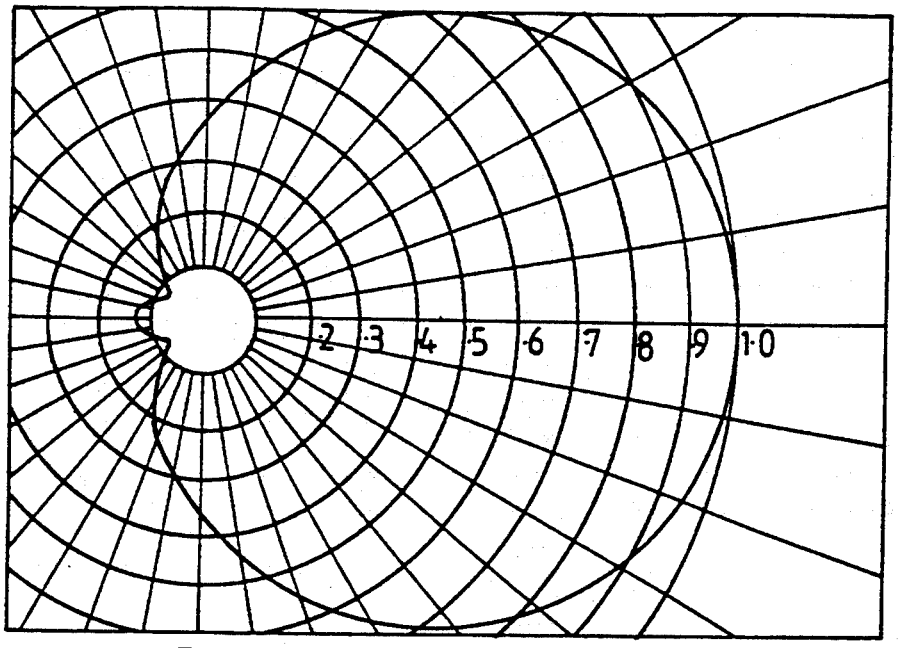
FIGS. 17*f–g*: show the horizontal (H-plane) radiation patterns for the configurations shown in FIGS. 17*b* and 17*d*.

The walls 104*a*, 106*a*, 108*a* and 110*a* may have positive, negative or equal values. FIGS. 17*b* and 17*c* show positive values. FIGS. 17*d* and e show negative values. By inclining the back plane as shown in FIG. 17*d* and 17*e*, a front to back ratio better than 20 dB can be achieved. Referring to FIG. 17*f*, a radiation plot for a panel antenna of the form shown in FIG. 17*b* is shown for a beamwidth of 105.6°. The height of the radiating element above the ground plane is 0.223 L and the width of the ground plane is 0.564 L.

Figure 17G:
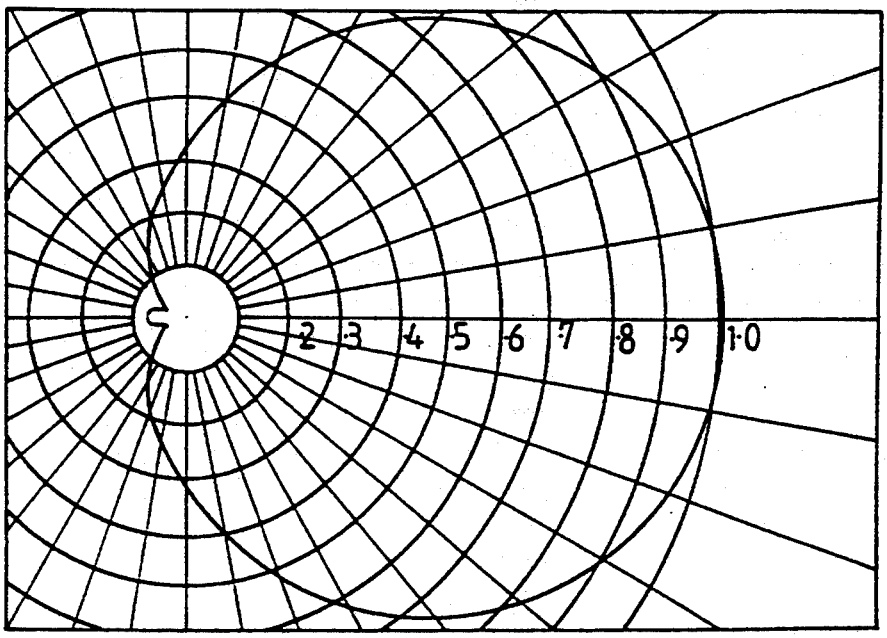

FIG. 17*g* shows a radiation plot for a beam width of 105.33° for the panel antenna shown in FIG. 17*e*. It will be seen that the back of the radiation pattern (ie: on the left hand side) does not project beyond the innermost circle as did the radiation pattern in FIG. 17*f*. The result is a front to back ratio of 22.66 dB. The panel antenna width is 0.944 L and the height of the dipole above the ground plane is 0.25 L. The included angle is 173.2° and the negative sidewalls of 0.18 L length. The negative sidewalls further increase the front-to-back ratio and also provide a mounting for a swivel mechanism.

Figure 19A:
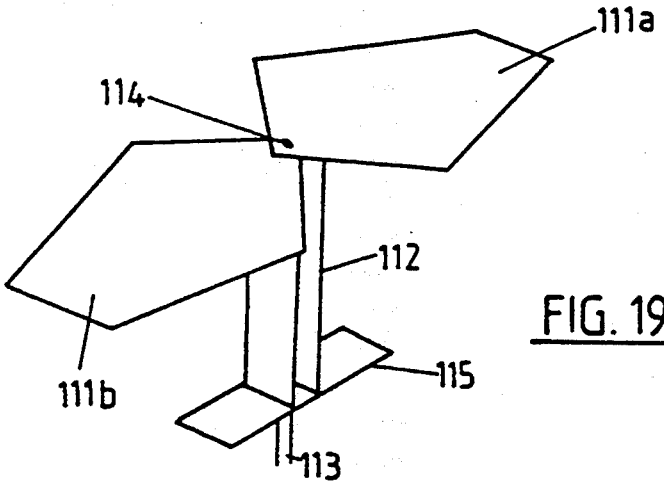
FIG. 19*a*: shows a dipole element of the array shown in FIG. 18.
Figure 19B:
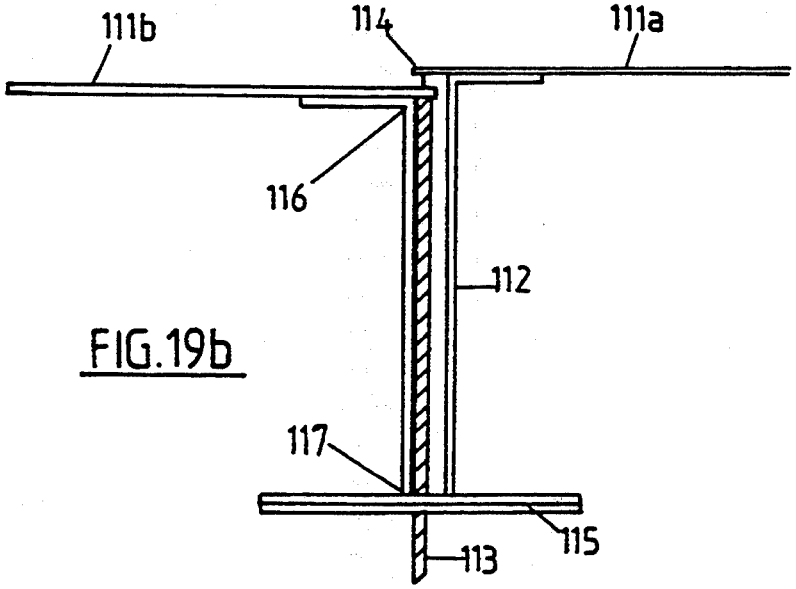
FIG. 19*b*: shows a side view of the dipole element shown in FIG. 19*a*.

Referring now to FIG. 19*a* and 19*b*, the preferred dipole element for the panel driver shown in FIG. 18 is shown. This dipole element is suitable for use in wide beam width embodiments. Radiating elements 111*a* and *b* are supported by balun 112 and fed by cable 113. The outer conductor of the coaxial cable 113 is solder bonded at 116. The inner conductor extends to radiating element 111*a* and is soldered thereto at 114. The outer conductor of the coaxial cable is also solder bonded at point 117. Flange 115 enables the attachment of the dipole element to a channel as shown in FIG. 18.

Figure 19C:
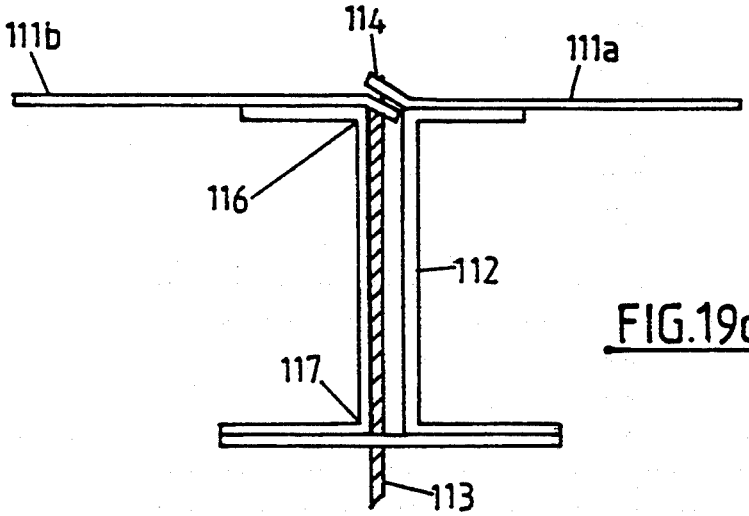
FIG. 19*c*: shows an alternative dipole configuration.

In FIG. 19*c* an alternative embodiment is shown in which the adjacent ends of radiating elements 111*a* and 111*b* are upturned and downturned respectively so that the ends may be overlapping whilst radiating elements 111*a* and 111*b* are at the same level.

Figure 20:
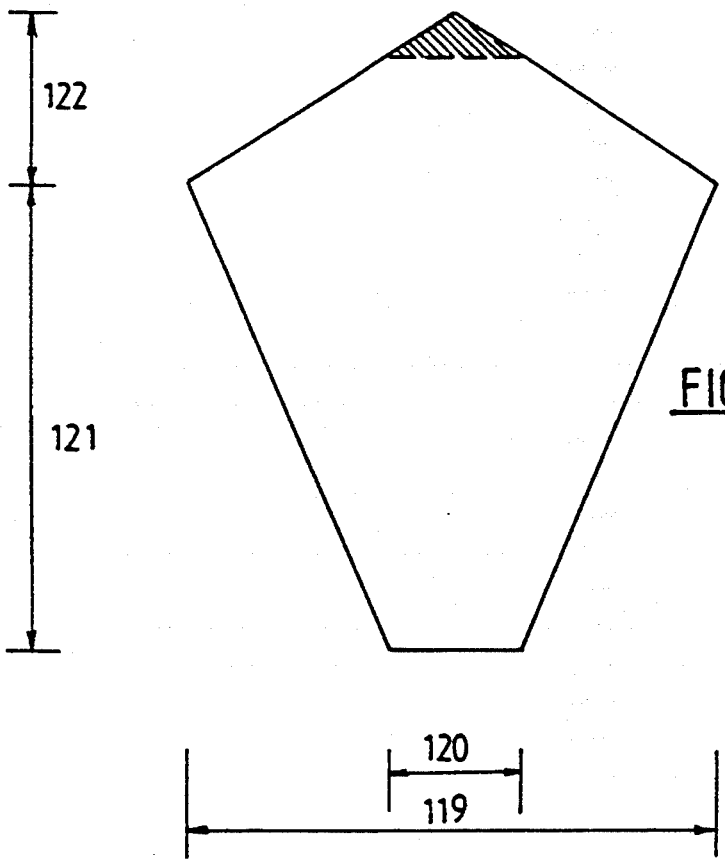
FIG. 20: shows a radiating element of the dipole shown in FIGS. 19*a* and 19*b*.

FIG. 20 is a planar view of one of the radiating elements 111*a/b* shown in FIGS. 19*a–c*. The dimensions of the radiating element are preferably approximately as follows:

119–0.21 L
120–0.053 L
121–0.184 L
122–0.068 L.

These flat dipole elements are preferred for wider beam width panels (60°–180°) as they are cheaper to manufacture. The spread of radiation resistance and electrical resistance is dependant upon the shape of the dipole element. It has been found that the shape of dipole element shown in FIG. 20 produces a reactance spread which is within the 14 dB return loss limit.

Mechanisms for mechanically tilting the beam of the panel antenna will now be described. It is an advantage of the present invention that the ground plane of the panel antenna can be fitted with respect to a housing to allow easy adjustment of mechanical down tilt.

Figure 6:
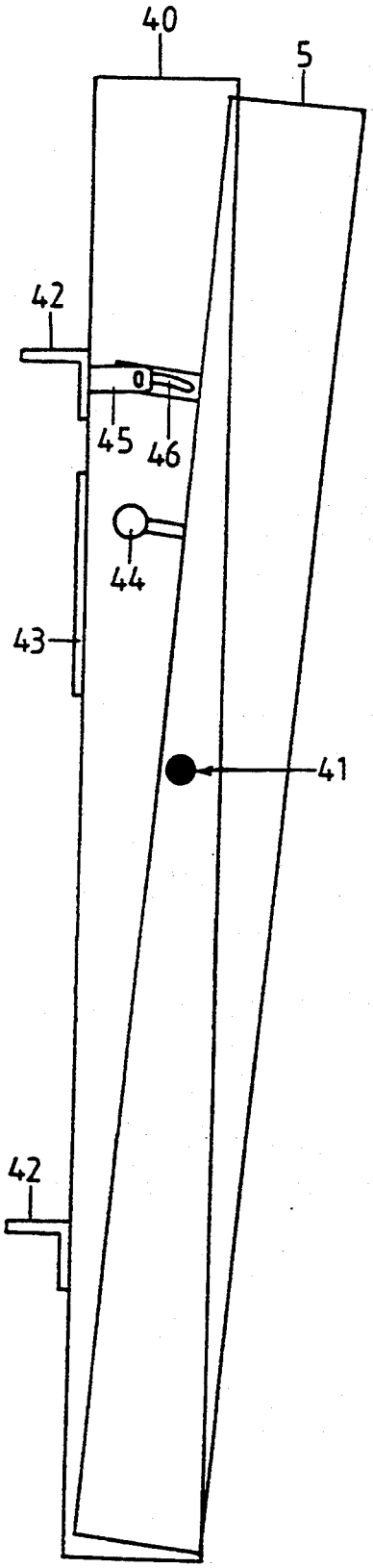
FIG. 6: shows a possible housing and tilt mechanism for the panel antenna.

Referring now to FIG. 6 a first mechanism to provide mechanical down-tilt of the ground plane is shown. The equivalent of the panel shown in FIG. 1 is seen housed within housing 40 in FIG. 6. Panel 5 is rotatable with respect to housing 40 about pivot centre 41 near the centre of gravity. Housing 40 may be mounted to a building or tower or vertical pipe etc by means of brackets 42 etc.

Figure 7:
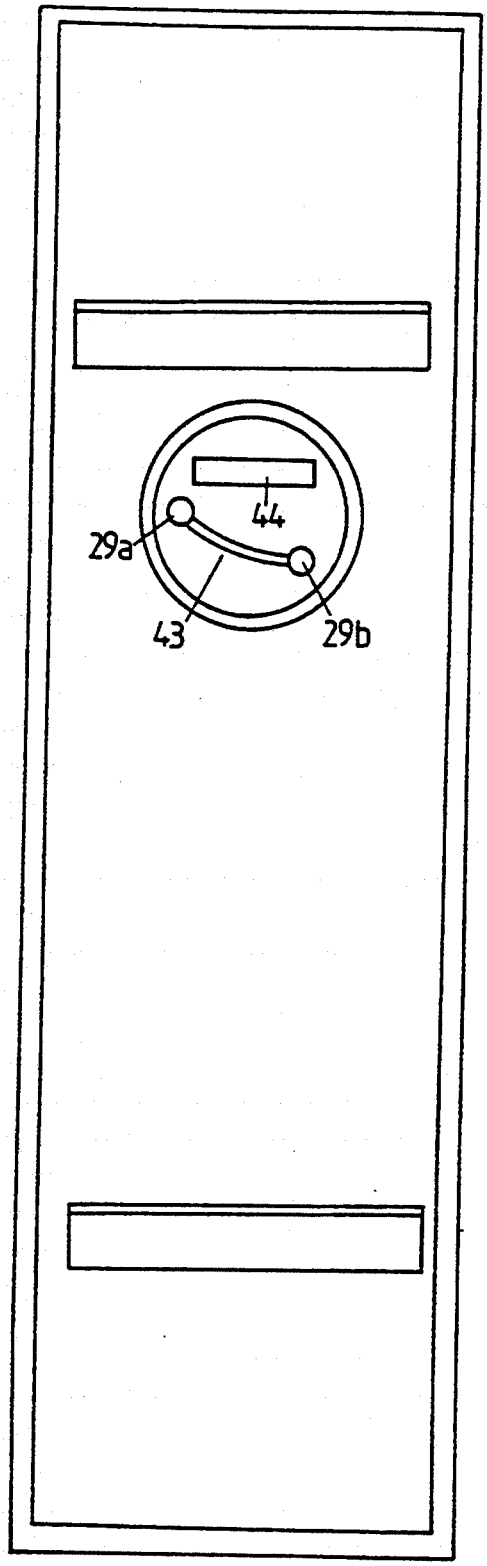
FIG. 7: shows the back panel of the assembly shown in FIG. 6.
Figure 8:
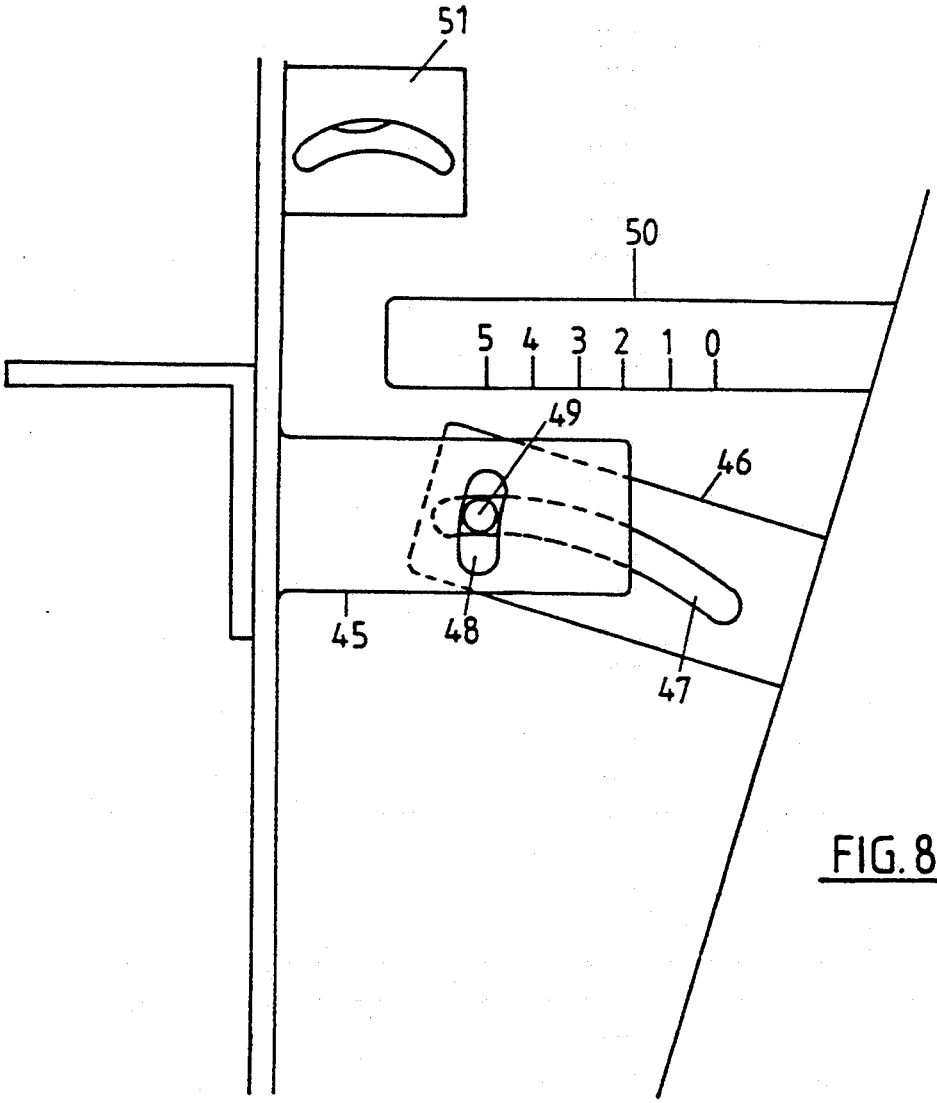
Figure 7A:
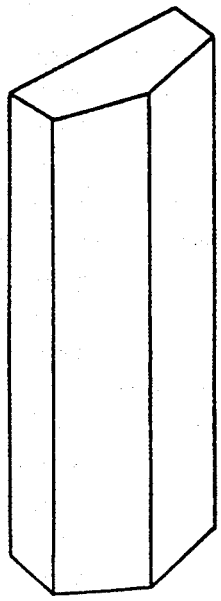
FIG. 7*a*: shows a cover which may be used to cover the assembly shown in FIG. 6.

By allowing rotation of panel 5 with respect to housing 40 a certain degree of mechanical down tilting of the antenna beam may be achieved. In one embodiment, with reference to FIGS. 7 and 8 as well, an aperture 43 may be provided in the back of housing 40 through which a person can grasp handle 44 and by pushing or pulling rotate panel antenna 5 with respect of housing 40.

A pair of lugs 45 and 46 are attached to housing 40 and panel 5 respectively. Lug 46 has an arcuate slot 47 therein which corresponds with the arc of a circle about point 41. Lug 45 has a slot 48 therein in the vertical direction. A bolt 49 passes through the slots 47 and 48 so as to restrict rotation of panel antenna 5 with respect to housing 40 to the movement allowed between the ends of slot 47. Complimentary brackets 45 and 46 may be provided on the other side of the housing and ground plane. A tube may extend between the lugs at either side, through which passes a rod with a head at one end and thread at the other. A nut can be fastened to the threaded end to clamp together the brackets 45 and 46 and prevent rotation of the ground plane with respect to the housing.

In use an operator may grasp handle 44 and rotate panel antenna 5 with respect to housing 40 until bolt 49 is adjacent the required amount of down tilt indicated on indicator 50. When in the correct position the operator will then fasten a nut (not shown) to bolt 49 to secure the assembly firmly in place and prevent further rotation of panel 5. A spirit level 51 may also be provided so that an operator may check to see that the assembly is level when initially installed.

Connectors 29*a* and 29*b* may be positioned so as to be easily accessible through aperture 43. In this way lengths of cable may be easily interchanged to give different degrees of down tilt.

Thus, the panel antenna of the present invention provides for a combination of customer adjustable mechanical down tilt and customer adjustable electrical down tilt (by varying the length of cable 29).

Different lengths of cable 29 may be provided to give incrementally greater amounts of electrical down tilt, with mechanical down tilt equal to the incremental steps being available. In this way steps of 5° electrical down tilt may be provided (ie 0°, 5°, 10° cable delays )

and fine tuning may be achieved within the range of 5° mechanical down tilt. A total of 15° down tilt may be achieved in this embodiment.

Anywhere from 2° to 15° mechanical down tilt may be provided depending upon the particular configuration. For 8 dipole pairs 2.5° mechanical down tilt may be appropriate, whereas 10° mechanical down tilt may be appropriate for 2 dipole pairs.

For some applications only electrical down tilt may be required and panel 5 may be directly mounted without the need for housing 40 or the mechanical down tilt mechanism. If only electrical down tilt is employed then a greater range of cable lengths 43 may be provided to allow finer control of the amount of down tilt.

According to another embodiment a plurality of switches may be provided on the back of panel 5 which enable the lengths of a plurality of feed lines to be adjusted. If the length of a number of feed lines can be adjusted then a better radiation pattern can be achieved for the non-optimum angles of down tilt. This approach is however more expensive. In another embodiment the feed line lengths may be adjusted remotely using a solenoid rotary switch etc.

FIG. *7a* shows a cover suitable for covering the whole antenna assembly. This may be formed of rovel (styrene acrylonitrite copolymer) which is a material having low radio frequency loss and high resistance to ultraviolet radiation. Cover *7a* protects the front and sides from the elements with access port 43 being closed by a suitable weather-proof portal cover.

Figure 9:
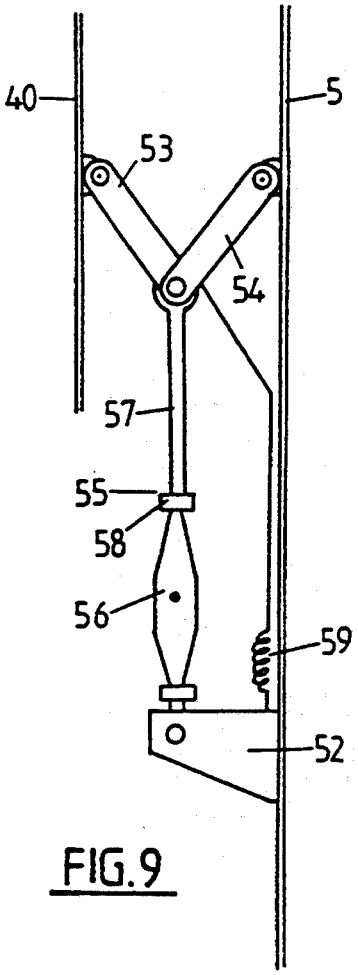
FIG. 9: shows an alternative tilting mechanism.

Referring now to FIG. 9 an alternate mechanism for adjusting mechanical down tilt is shown. A bracket 52 is secured to the back of panel 5 with members 53 and 54 being pivotally connected to each other and box 40 and panel 5 respectively. Adjustment means 55 is connected between the point of connection of members 53 and 54 and bracket 52.

Figure 10:
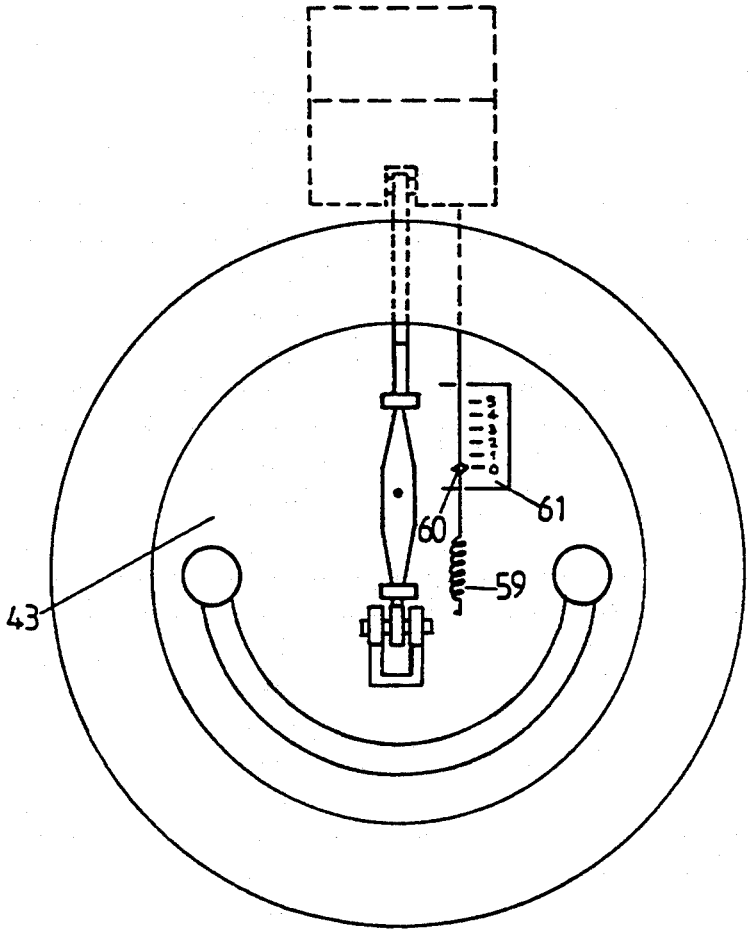
FIG. 10: shows the tilting mechanism of FIG. 9 as seen through the aperture in the back panel.

The length of adjustment means 55 may be adjusted by rotating turn buckle 56 with respect to threaded shaft 57. As the length of adjustment means 55 is increased members 53 and 54 are straightened which tilts panel 5 further forward with respect to box 40. A lock nut 58 is provided to secure the mechanism when the desired degree of down tilt is achieved. A spring 59 may be connected between bracket 52 and the intersection of members 53 and 54. This spring may be provided with an indicator 60 which moves along a graduated scale 61 to indicate the degree of down tilt (as best seen in FIG. 10).

This mechanism has the advantage that fine adjustment may easily be made by an operator through port 43 and the operator need have no special tools. Panel 5 will preferably be electrically isolated from box 40 so as to prevent corrosion and members 53 and 54 will preferably be formed of an insulating material.

Figure 11:
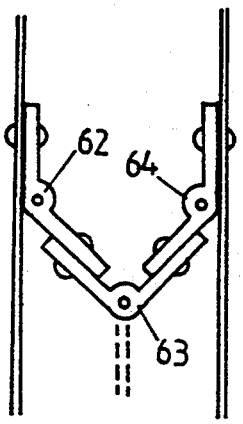
FIG. 11: shows an alternative construction of the mechanism shown in FIG. 9.
Figure 12:
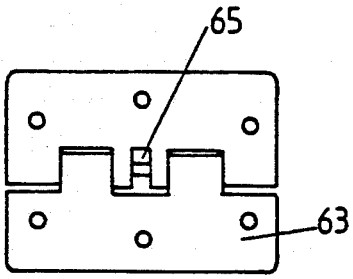
FIG. 12: shows the central hinge of the mechanism shown in FIG. 11.

Referring now to FIG. 11 an embodiment is shown in which members 53 and 54 shown in FIG. 9 are formed by three hinges 62, 63 and 64. This configuration has the advantage that the hinges have very little movement about their joints so the assembly will be securely fastened in place. The hinges 62, 63 and 64 will preferably be formed of nylon or plastic material to isolate box 5 from box 4. The hinge 63 shown in FIG. 12 will preferably have a notch 65 therein to allow attachment of the adjustment means 55.

Figure 22:
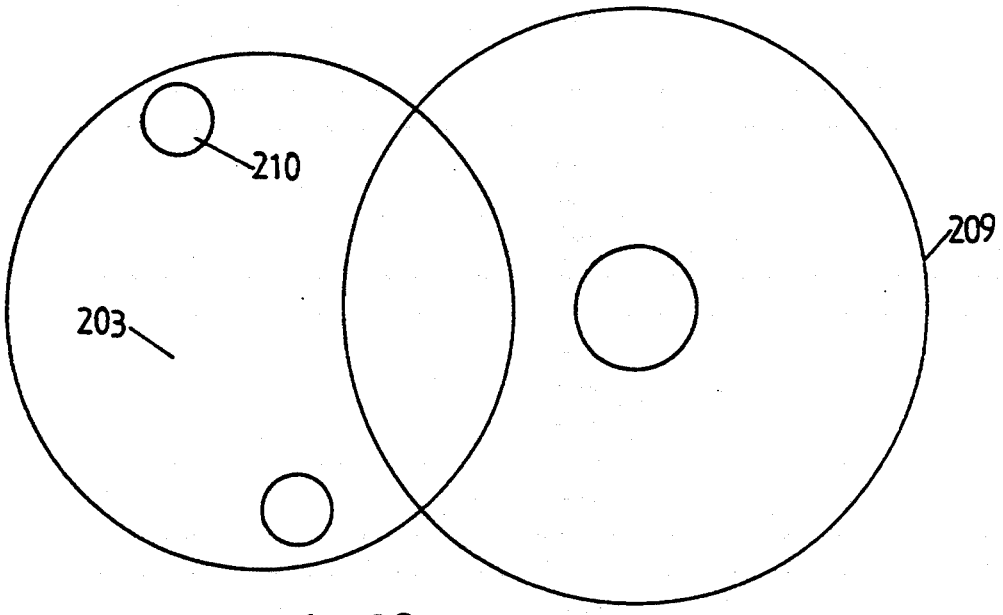
FIGS. 21 to 23: show an alternative mechanical down-tilt mechanism.
Figure 21:
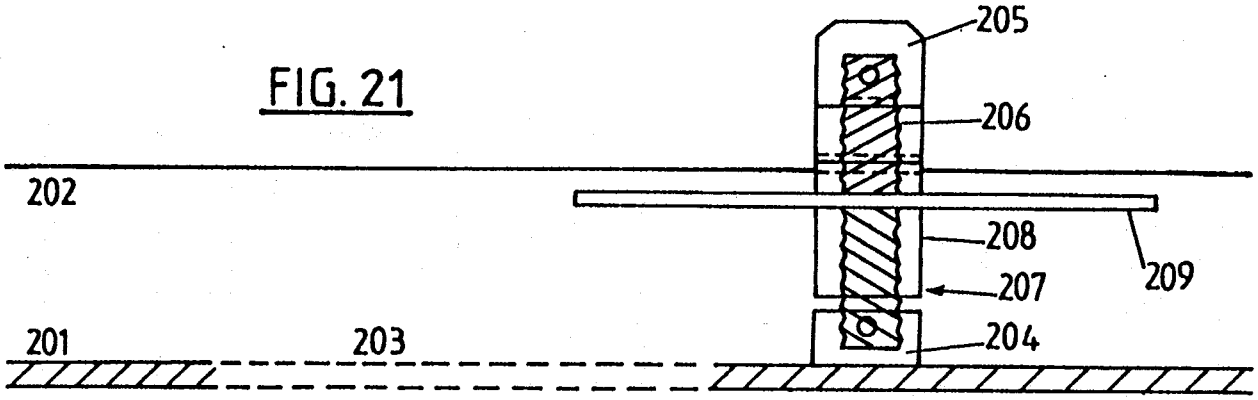
Figure 23:
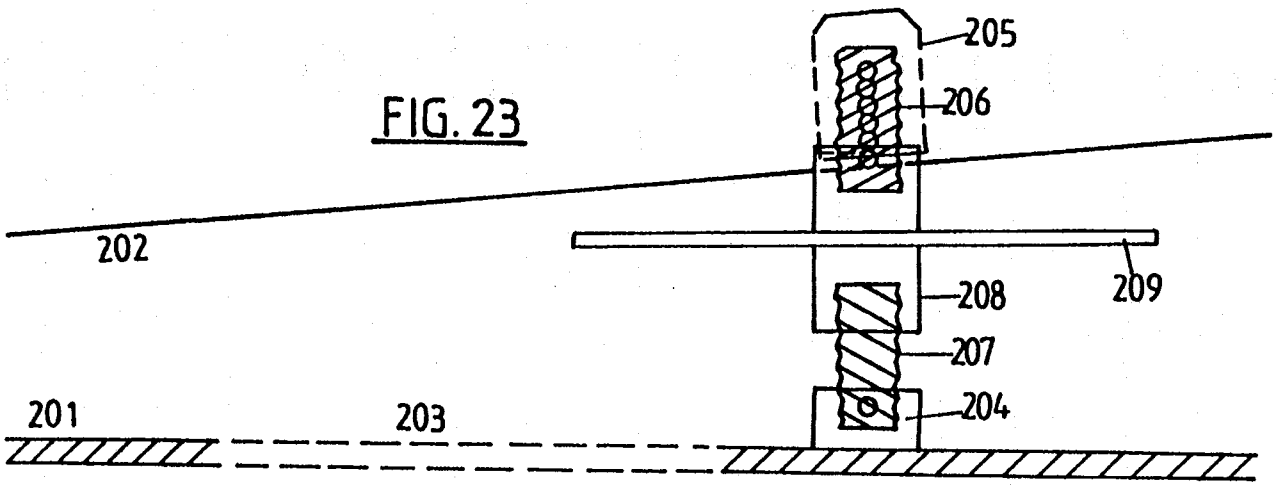

Referring now to FIGS. 21 to 23 an alternative tilting mechanism is shown. Ground plane 202 has a bracket 205 secured thereto with a threaded rod 206 extending therefrom. Mounting plate 201 has a bracket 204 secured thereto with a threaded rod 207 extending therefrom. Access port 203 allows one to effect mechanical down tilting by rotating wheel 209 and also allows one to interchange cables easily by attaching them to connector 210. Threads 206 and 207 are of opposite types (ie: one is a left hand thread and one is a right hand thread). Turnbuckle 209 has a central nut 208 having right handed and left handed threads in either end thereof to engage with threaded rods 206 and 207. When turnbuckle 209 is rotated in a first direction ground plane 202 is forced away from mounting plate 201. When turnbuckle 209 is rotated in the other direction ground plane 202 is drawn towards mounting plane 201. Accordingly tilting of ground plane 202 with respect to mounting plate 201 can be effected with this mechanism.

Turnbuckle 209 can be connected to suitable motorised driving means to allow the remote mechanical tilting of the ground plane. It may be appropriate to include a speed reducing unit to achieve the desired speed of operation. It may also be appropriate to include means to sense the degree of mechanical downtilt.

Where the degree of mechanical down tilt is to be adjusted remotely the tilting mechanism may be driven by an electric motor through a suitable assembly.

Figure 13:
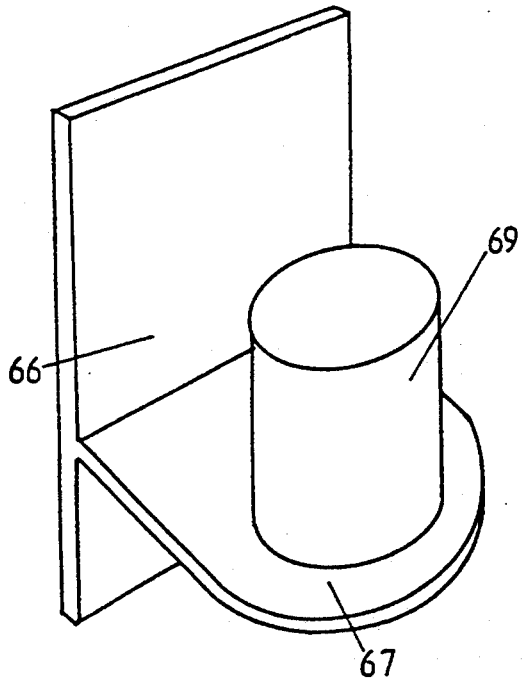
FIGS. 13 and 14: show a wall mounting bracket for use in securing the panel antenna.
Figure 14:
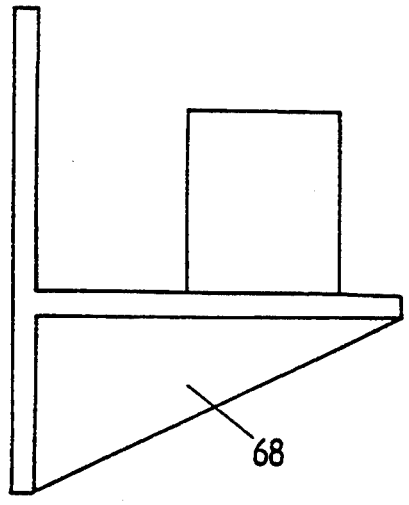
Figure 15:
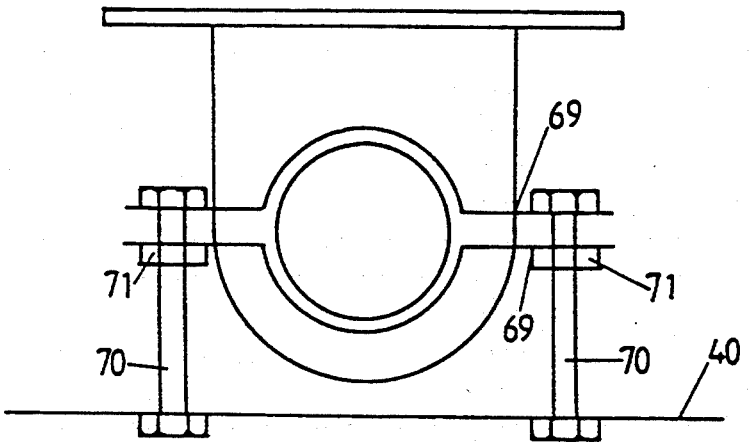
FIG. 15: shows a means of attaching the panel antenna to the wall mounting bracket.

Referring now to FIG. 13 a mounting bracket for securing the panel antenna assembly to a wall is shown. The bracket is seen to comprise a back plate 66, a horizontal plate 67, an angle support plate 68 and a cylindrical pin 69. Back plate 68 may be affixed to a wall by any suitable means such as bolting. A panel antenna assembly may be mounted onto two such vertically disposed support brackets using two mounting brackets 69 fastened together by bolts 70 and nuts 71. This assembly has the advantage that the panel antenna assembly is rotatable with respect to the brackets through 40° in either direction. This assists in adjustment of the antenna down tilt after installation as upon loosening of nuts 71 the panel antenna assembly may be rotated to enable access through the rear thereof.

Where the panel assembly is to be secured to a transmission tower, bracket 69 may be affixed directly onto the tubing thereof.

The present invention thus provides a cheap and relatively simple panel antenna having customer adjustable electrical and mechanical down tilt which is particularly suitable for application in cellular telephone networks.

Where in the aforegoing description reference has been made to integers having known equivalents then such equivalents are herein incorporated as if individually set forth.

Although this invention has been described by way of example and with reference to possible embodiments thereof it is to be appreciated that improvements and modifications may be made thereto without departing from the scope or spirit of the present invention.

What is claimed is:

1. A microwave panel antenna for generating a beam, comprising:

(a) a plurality of dipoles, said dipoles mounted on a ground plane above and in spaced apart relationship therewith, said dipoles and said ground plane disposed within a housing;

(b) a means to electrically tilt the transmitted beam in a stepped manner by varying the phase of a signal input to a first group of said dipoles in relation to the phase of said signal input to a second group of said dipoles, wherein said electrical tilt means comprises a plurality of delay lines of different physical lengths, selected ones of which are mechanically inserted in series in the electrical path of said signal input to one of said groups of said dipoles to cause said varying of the phase of the signal input to said first group of dipoles, said delay lines being of lengths which cause the angles of electric beam tilting to equal approximate integer multiples of a coarse angle of beam tilt; and (c) a means to mechanically tilt said ground plane with respect to said housing, said mechanical tilt means providing continuously adjustable fine tilting of said ground plane with respect to said housing throughout said coarse angle of beam tilt.

2. A panel antenna as claimed in claim 1 wherein the coarse angle of beam tilt is between 2°–15°.

3. A panel antenna as claimed in claim 1 which further comprises a channel section upon which the dipoles are supported above the ground plane.

4. A panel antenna as claimed in claim 3 wherein sides of the ground plane are angled away from the channel section.

5. A panel antenna as claimed in claim 1 wherein a matching section is provided in a main feed line to match the antenna impedance to that of a signal source feeding the antenna, wherein the matching section consists of an outer tubular conductor, an inner conductor and a tubular dielectric section between the outer tubular conductor and inner conductor, the dielectric section being shorter than the outer tubular conductor.

6. A panel antenna as claimed in claim 5 wherein the dielectric section is formed of polytetraflouroethylene and is moveable towards either end of the matching section.

7. A panel antenna as claimed in claim 1 wherein unequal power dividers are inserted in feed lines feeding said dipoles to decrease the sidelobes of the panel antenna beam.

8. A panel antenna as claimed in claim 1 having at least four dipoles.

9. A panel antenna as claimed in claim 1 wherein said dipoles have elongated pentagonally shaped radiating elements.

10. A panel antenna as claimed in claim 1 wherein the ground plane is tiltable about one end thereof and the other end is secured to the housing by a turnbuckle arrangement which, upon rotation, allows mechanical down-tilting of the antenna beam.

11. A panel antenna as claimed in claim 1 wherein said means to mechanically tilt said ground plane is performed by an electric motor via a mechanical linkage connected between the ground plane and the housing.

12. A panel antenna as claimed in claim 9 wherein said dipoles are arranged in a row.

13. A panel antenna as claimed in claim 9 wherein said dipoles are arranged in parallel rows of opposed dipoles.

14. A panel antenna as claimed in claim 1 wherein a phase delay to each dipole increases from one end of the antenna to the other.

15. A panel antenna as claimed in claim 1 wherein the plurality of delay lines comprises a plurality of different length cables and said electrical path of said signal input to one of said groups of said dipoles comprises a feed line, wherein a selected one said different length cables is inserted into said feed line, thereby increasing the length of said feed line and causing said varying of the phase of the signal input to said first group of dipoles.

16. A microwave panel for generating a beam, comprising:

(a) a plurality of dipoles, each of said dipoles mounted on a ground plane above and in spaced apart relationship therewith, said dipoles and said ground plane disposed within a housing;

(b) a means to electrically tilt the transmitted beam by varying the phase of a signal input to a first group of said dipoles in relation to the phase of said signal input to a second group of said dipoles, wherein said electrical tilt means comprises a plurality of delay lines of different lengths that are selectively inserted in the electrical path of said signal input to one of said groups of said dipoles to cause said varying of the phase of the signal input to said first group of dipoles; and (c) a means to mechanically tilt said ground plane with respect to said housing;

wherein the ground plane is tiltable about a horizontal pivot axis near its center of gravity, said ground plane having secured on either edge thereof brackets having arcuate slots therein, said housing having brackets secured thereto with apertures adjacent said arcuate slots, a hollow tube extending between said pairs of brackets having therein a rod passing through said arcuate slots and apertures and having a head at one end thereof, the other end of said rod being threaded and fitted with a nut, wherein upon fastening of said nut, both edges of said ground plane are secured against rotation with respect to said housing.

* * * * *